US006076917A

United States Patent [19]

Wen

[11] Patent Number: 6,076,917

[45] **Date of Patent: *Jun. 20, 2000**

[54] INK JET PRINTING OF COLOR IMAGE AND ANNOTATIONS

[75] Inventor: Xin Wen, Rochester, N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/164,247

[22] Filed: Sep. 30, 1998

[51] Int. Cl.[7] ..... B41J 2/21; B41J 2/145; B41J 2/15

[52] U.S. Cl. ..... 347/43; 347/40

[58] Field of Search ..... 347/43, 15, 40, 347/100

[56] References Cited

U.S. PATENT DOCUMENTS

| | | | |
|---|---|---|---|
| 4,325,086 | 4/1982 | Sato et al. | 347/15 |
| 4,713,746 | 12/1987 | Watanabe et al. | 347/15 |
| 4,745,413 | 5/1988 | Brownstein | 347/182 |
| 5,420,627 | 5/1995 | Keefe et al. | 347/87 |
| 5,550,569 | 8/1996 | Wright | 347/15 |
| 5,598,196 | 1/1997 | Braun | 347/68 |
| 5,710,582 | 1/1998 | Hawkins et al. | 347/42 |
| 5,757,407 | 5/1998 | Rezanka | 347/102 |
| 5,793,392 | 8/1998 | Tschida | 347/40 |

FOREIGN PATENT DOCUMENTS

| | | | |
|---|---|---|---|
| 771 658 A2 | 10/1996 | European Pat. Off. . | |
| 827 833 A2 | 7/1997 | European Pat. Off. . | |
| 406155770 | 6/1994 | Japan | 347/43 |
| 98/08687 | 8/1997 | WIPO . | |

*Primary Examiner*—N. Le
*Assistant Examiner*—Thinh Nguyen
*Attorney, Agent, or Firm*—Raymond L. Owens

[57] ABSTRACT

Ink jet printing apparatus forms a color image from the digital image file and high-resolution annotation information relative to the color image on a receiver in response to a digital image and annotation information. The ink jet printing apparatus includes a print bar disposed at a first image transfer position across at least a portion of the width of the receiver and adapted to deliver colorants to the receiver to form a color image on the receiver, and a print head assembly spaced from the print bar and disposed at second image transfer position and adapted to be moved in a direction across the width direction of the receiver for delivering ink to the receiver to form annotation information on the receiver. The ink jet printing apparatus further includes control circuitry which causes the print head assembly to be transported relative to the receiver and for transporting the receiver relative to the print bar and the print head assembly. Print head drive electronics is responsive to the annotation information and the digital image for respectively actuating the print head assembly and the print bar to form a color image and annotation information relative to such color image on the receiver.

10 Claims, 3 Drawing Sheets

INK JET PRINTING OF COLOR IMAGE AND ANNOTATIONS

CROSS REFERENCE TO RELATED APPLICATIONS

The present invention is related to U.S. patent application Ser. No. 09/118,538, filed Jul. 17, 1998, entitled "Borderless Ink jet Printing on Receivers"; U.S. patent application Ser. No. 09/133,879, filed Aug. 14, 1998, entitled "Compensating for Receiver Skew in Ink jet Printer"; and U.S. patent application Ser. No. 09/135,308, filed Aug. 17, 1998, entitled "Ink Jet Printing With Enhanced Image Quality".

FIELD OF THE INVENTION

The present invention relates to ink jet printing of color images and annotation information.

BACKGROUND OF THE INVENTION

Photographic prints produced by silver halide chemistry has been a popular means for people to share memories and experiences. These photographic prints are produced by optical exposures on photographic receiver coated with sensitized materials. Photographic prints are of high quality, low cost, and easy to use. These attributes have largely been responsible for the success of photography in the last 100 years. One requirement for a digital printer used in a minilab is that the pictorial images need to be printed at high enough bit-depth to eliminate any perceived contouring (or posterization) image artifacts caused by the quantization in the printed optical densities. Although ink jet printers have been known to produce color images and annotations for homes and offices, no ink jet printing systems are suitable for minilabs.

Another requirement for a digital printer for a minilab is that annotations such as graphics or text can be added to the pictorial image. These may include the date and the location related to the pictorial image, the time of the printing, and copyright symbols. The annotations can be printed within or on the borders of the color image. The color image may also be generated on a computer. As it is well known in the art, annotations such as text and other graphic information are most desirably printed at high resolution so as to have appropriate sharpness.

Yet another requirement for a minilab is that color prints need to be produced at high throughput. Typically, several hundreds of 4" by 6" prints need to be printed within each hour. These color images are normally printed at high ink coverage. Annotations, however, are usually printed at very low ink coverage for most printed color images.

SUMMARY OF THE INVENTION

An object of this invention is to provide an ink jet printing apparatus that is capable of printing color images at high bit-depth and for printing high resolution annotation information relative to the color image.

This object is achieved by ink jet printing apparatus responsive to a digital image file and annotation information for forming a color image from the digital image and high-resolution annotation information relative to the color image on a receiver, comprising:

a) a print bar disposed at a first image transfer position across at least a portion of the width of the receiver and adapted to deliver colorants to the receiver to form a color image on the receiver;

b) a print head assembly spaced from the print bar and disposed at second image transfer position and adapted to be moved in a direction across the width direction of the receiver for delivering ink to the receiver to form annotation information on the receiver;

c) control means for transporting the print head assembly relative to the receiver and for transporting the receiver relative to the print bar and the print head assembly; and d) print head drive electronics responsive to the annotation information and the digital image for respectively actuating the print head assembly and the print bar to form a color image and annotation information relative to such color image on the receiver.

ADVANTAGES

An advantage of this invention is that color images and annotation information can be formed on a receiver in a highly efficient manner. The color image can be printed by a print bar at high bit-depth at high printing speed. The print bar can deliver colorants to the receiver using ink jet or thermal dye sublimation techniques.

Another advantage of this invention is that annotation information are printed at high resolution by narrow ink jet print heads.

A further advantage is that annotation information can be placed in desired locations relative to the color image such as on borders adjacent the image or on the image.

DETAILED DESCRIPTION OF THE INVENTION

The present invention is described with relation to ink jet printing apparatus that can print both ink images at high bit-depth and ink images at high resolution. In the present invention, the terminology bit depth refers to the number of distinguishable optical densities at each image pixel. The terminology resolution refers to ink dot sizes on the receiver, typically expressed ink dots per inch.

Figure 1:
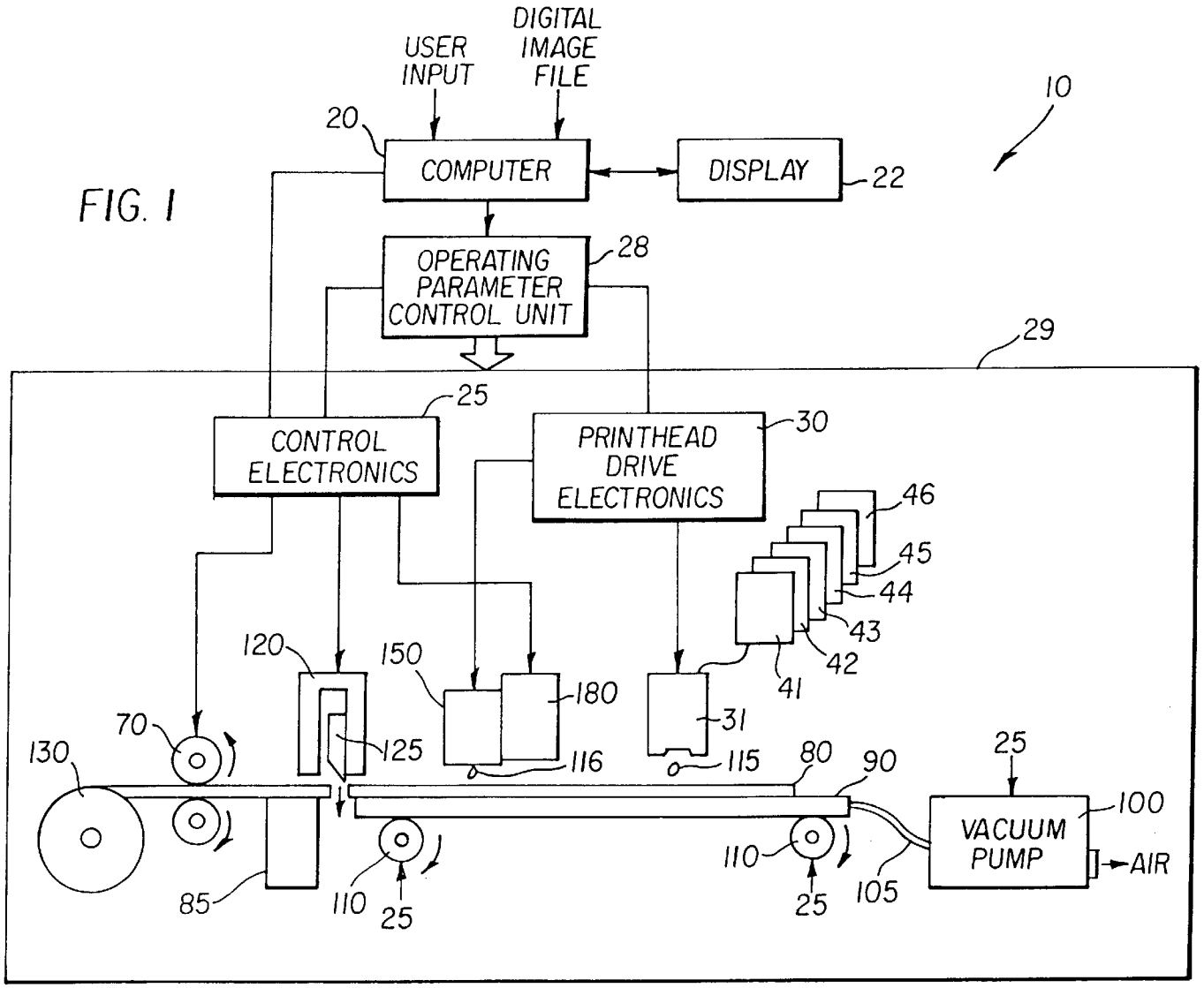
FIG. 1 is a schematic front view of the ink jet printing apparatus in accordance with the present invention.
Figure 2:
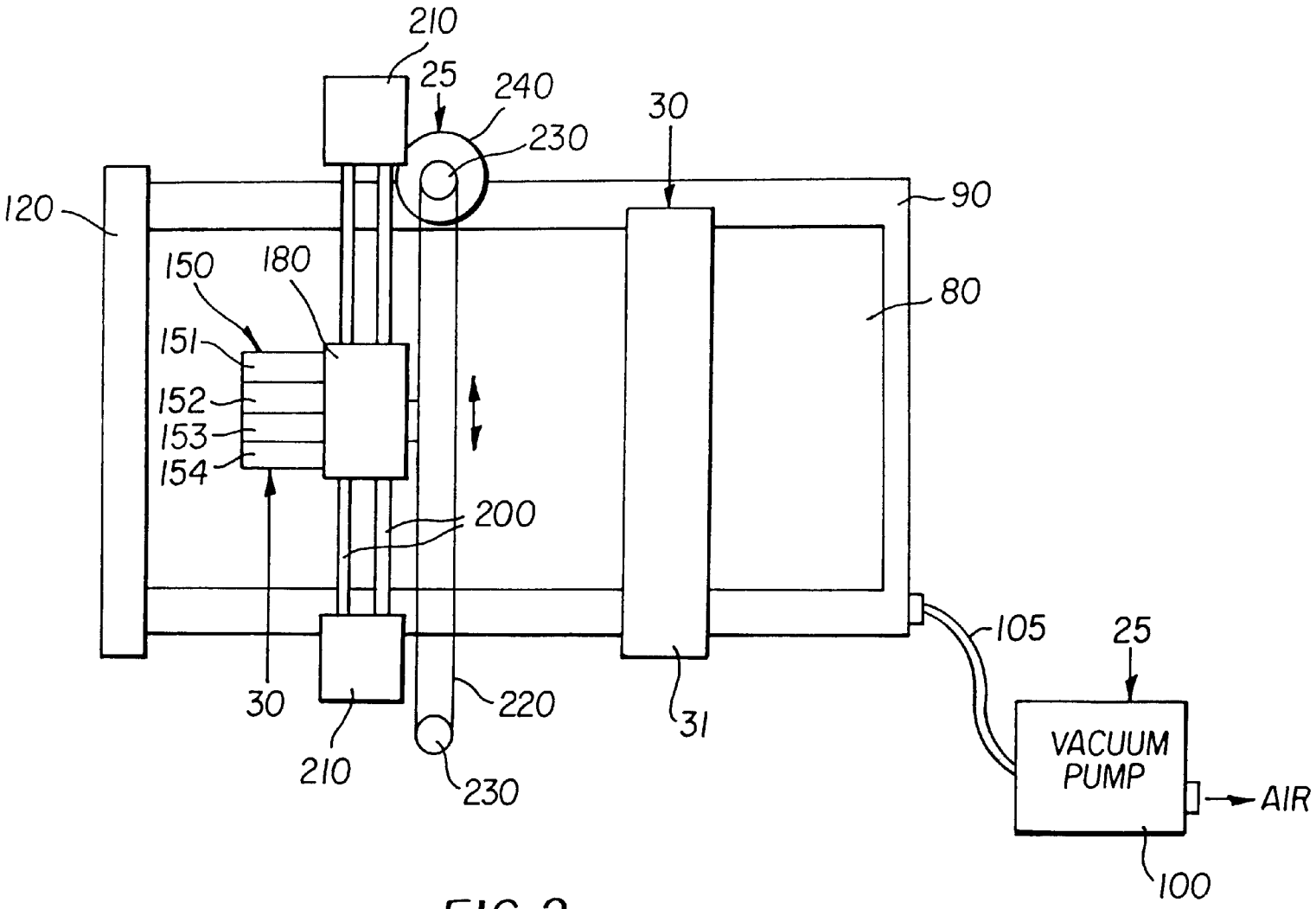
FIG. 2 is a partial top view of the ink jet printing apparatus of FIG. 1.

Referring to FIGS. 1 and 2, an ink jet printing apparatus 10 comprises a computer 20, a display 22, control electronics 25, operating parameter control unit 28, and the printer engine 29. The computer 20 receives user input and a digital image file. The print head drive electronics 30 causes the printing of the annotation information and the colored image. The printer engine 29 includes printhead drive electronics 30, print bar 31, a plurality of ink reservoirs 41–46 for providing the colored inks to the print bar 31, and a narrow print head assembly 150. The print bar 31 and the narrow print head assembly 150 are disposed at image transfer positions relative to the receiver. The print bar includes at least one color ink jet print head which is disposed substantially across the full width of the receiver. The print head assembly 150 is spaced from the print bar 31 and is disposed at another image transfer position. Under the control of control electronics 25, the print head assembly 150 is adapted to be moved in a direction across the width of the receiver 80 and delivers ink drops 116 to the receiver 80 to form annotation information on the receiver 80. The colored inks supplied to the print bar 31 include yellow, dark magenta, light magenta, dark cyan, light cyan, and black inks. The colorants can have different concentrations for each color such as the light magenta and light cyan relative to the dark magenta and cyan, respectively. The narrow print head assembly 150 contains yellow print head 151, magenta print head 152, cyan print head 153, and black print head 154. Each of the yellow, magenta, cyan, and black print heads 151–154 contains an ink cartridge that are detachable after each colored ink is used up for that particular print head. Furthermore, the print bar 31 and the print heads 151–154 can also include red, orange, gold, silver, green, and blue ink colors for expanding the color gamut of the ink jet printing apparatus 10. It is also understood that the print bar 31 can use color printing techniques capable of multiple tone printing. These techniques include thermal dye diffusion, thermal transfer by a laser, or electrophotography. One such technique is disclosed, for example, in the commonly assigned U.S. Pat. No. 4,745,413 to Brownstein et al, the disclosure of which is incorporated herein.

The print bar 31 is disposed at an image transfer position and is preferably spanning over the full width the receiver 80. The narrow print head assembly 150 is attached to a print head holder 180 that is mounted on sliding rails 200. The yellow, cyan, magenta, and black print heads 151–154 are substantially narrower than the width of the receiver 80. The sliding rails 200 are supported by supports 210. The a print head holder 180 and thus the narrow print head assembly 150 can be translated by a belt 220, a pulley mechanism 230, and a motor 240 along the sliding rails 200 across the receiver 80. The motor 240 can be a DC motor. Although not shown, the transport for the narrow print head assembly 150 can further include positional feedback loop and a linear encoder.

The printer engine 29 further includes a receiver transport mechanism 70 for transporting a receiver 80 first over a receiver support 85 and then over a platen 90 under the print bar 31 at the image transfer position. The receiver 80 is held to the platen 90 by vacuum suction by a vacuum pump 100 via a vacuum tube 105 in response to the control electronics 25. Thereafter, the control electronics 25 cause both a colored image and annotation information Preferably, no mechanical components are used to hold on the ink receiving side of the receiver 80. This permits the print bar 31 to print freely across the whole receiver 80 from edge to edge. The platen 90 can be transported by platen transport device 110. The platen transport device 110 and the receiver transport mechanism 70 are both controlled by control electronics 25.

The operating parameter control unit 28 provides signals for automatically controlling the printer engine 29 including the narrow print head assembly 150 (for annotation information) and the print bar 31 (for the colored image) under the control of the computer 20. The control signals from the operating parameter control unit 28 controls. In a well known manner, the operating parameter control unit 28 can provide information to the print head drive electronics 30 to cause the ink drop ejection to vary. The operating parameter control unit 28 is also connected with the control electronics 25 and other components in the printer engine 29 for varying parameters related receiver transport, receiver cutting to change image format, printhead and receiver alignment, ink supply, vacuum suction, tone scale, color density (ink drop volume, number of drops per pixel), and so on.

Still referring to FIGS. 1 and 2, an ink jet printing apparatus 10 also includes a receiver cutter assembly 120 which houses a receiver cutter 125. The cutting operation of the receiver cutter 120 is controlled by control electronics 25. The receiver 80 can be cut before printing, as shown in FIGS. 1 and 2, or after printing to enable printing borderless ink image on the receiver 80. The receiver 80 can be provided by a web fed by receiver roll 130 which includes a wound web. In the instance where a web is used as the receiver it, of course, must be cut to size by the receiver cutter assembly 120. Or alternatively, the receiver 80 can also be fed as a cut sheet onto the platen 90 by receiver transport mechanism 70. Although flatbed platen 90 is shown in FIG. 1, it is understood that many other platen types are compatible with the present invention. For example, a belt, a roller, or a drum transport can be used for moving the receiver 80 under the print bar 31.

Although not shown in FIGS. 1 and 2, the control electronics 25 in the printer engine 29 can also include a receiver detection unit that is in bi-directional communication with the control electronics 25. The receiver detection unit can detect the lead and the side edges of a receiver for determining the length and width of the receiver 80. Thus, obtained receiver dimensions will enable the ink jet printing apparatus 10 to provide borderless ink image. Details of operation of printing a borderless image is disclosed in the above referenced and commonly assigned U.S. patent application Ser. No. 09/118,538, filed Jul. 17, 1998, entitled "Borderless Ink jet Printing on Receivers" to Wen, the disclosure of which is incorporated herein. The receiver detection unit can also measures image properties and produces signals from a printed test image for calibrating the operating parameters in the operating parameter control unit 28. Details of operation of calibrating the ink jet printing apparatus 10 is disclosed in the above referenced and commonly assigned U.S. patent application Ser. No. 09/135,308, filed Aug. 17, 1998, entitled "Ink Jet Printing With Enhanced Image Quality", the disclosure of which is incorporated herein.

Figure 3:
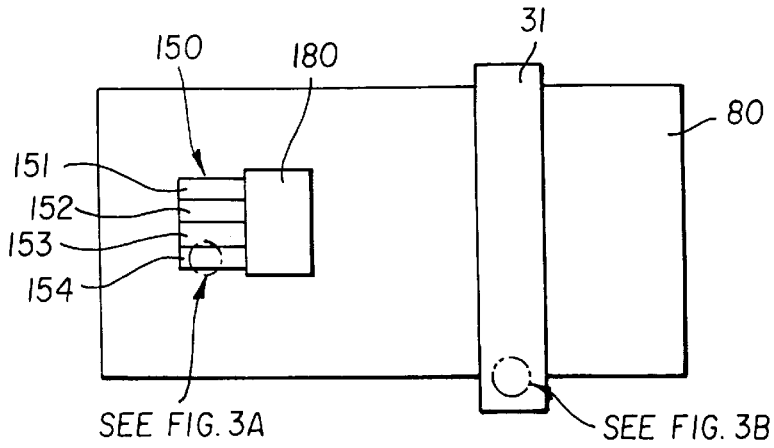
FIG. 3 another partial top view of the ink jet printing apparatus of FIG. 1 showing magnified portions of the ink nozzles in the print bar and the ink jet print heads, respectively.
Figure 3A:
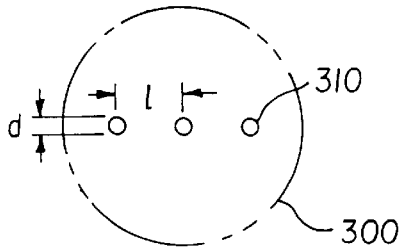
Figure 3B:
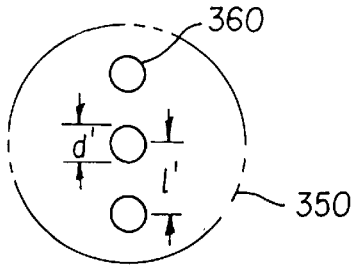

Referring now to FIG. 3, the yellow, magenta, cyan, and black print heads 151–154 in the narrow print head assembly 150 each has a plurality of ink nozzles 310 (see the magnified portion 300) aligned in arrays parallel to the receiver transport direction. The yellow, magenta, cyan and black print heads 151–154 print annotation information by placing ink drops 116 (FIG. 1) on the receiver 80. The ink drops can be actuated by ink jet techniques well known in the art such as provided by thermal and piezoelectric ink jet print heads. Examples of the ink jet print heads are disclosed in commonly assigned U.S. Pat. Nos. 5,598,196 and 5,420,627. The ink nozzles 310 have diameter d spaced apart by l distance. A typical l distance is in the range of $1/300$ to $1/720$ of an inch. The resolution of the annotation information is defined by the small ink dot sizes (shown in FIG. 4) produced by the print heads 151–154. Typically, the annotation information is printed by interlacing several printing passes by scanning the print heads 151–154 during the printing of each swath. The annotation information on the receiver is typically composed of a plurality of printing swaths with each swath printed by one printing pass of the narrow print heads 151–154.

The annotation information printed by the yellow, magenta, cyan, and black print heads 151–154 can include graphics, copyright, or text such as the date and the location related to the color image. The annotation information can be printed within or on the borders of the color image. As discussed in more detail in below, the annotation information is desirably printed at resolutions higher than that for the color image. The annotation information can be entered by user input to the computer 20 with the assistance of display 22. The annotation information can also include information stored in the computer such as serial number, printing time, and location and so on.

Still referring to FIG. 3, the print bar 31 includes a plurality of ink nozzles 360 (as shown in the second magnified portions 350) and associated ink drop activators for delivering different colored ink drops 115 (FIG. 1) to form the color image on the receiver 80. Although not required, the length of print bar 31 is preferably across the full width of the receiver 80 to ensure high throughput for the printing the color images. The print bar 31 can be provided by an assembly of ink jet printheads or by linear arrays of ink nozzles on a monolithic nozzle plate for each colored ink. As shown, the nozzle arrays are aligned perpendicular to the transport direction of the receiver 80. The ink nozzles 360 have diameter d' spaced apart by l' distance. The nozzle diameter d' in the print bar 31 is larger than the nozzle diameter d in the yellow, magenta, cyan and black print heads 151–154, reflecting the fact that the print heads 151–154 print small ink dots at higher resolution compared to the print bar 31. A typical l' distance is in the range of 1/300 to 1/720 of an inch. The print bar 31 is capable of printing high bit-depth color images for the pictorial images produced in minilabs. The ink drop ejection is actuated by ink jet techniques well known in the art such as disclosed in European Patent 771 658 A2 and EP 827 833 A2, the disclosure of which is incorporated herein. The bit depth in the color image can be provided by light color inks such as light cyan and light magenta inks and by variable ink drop sizes at each pixel in the color image. The variable drop sizes can be achieved by techniques disclosed in WO 98/08687, the disclosure of which is incorporated herein.

Figure 4:
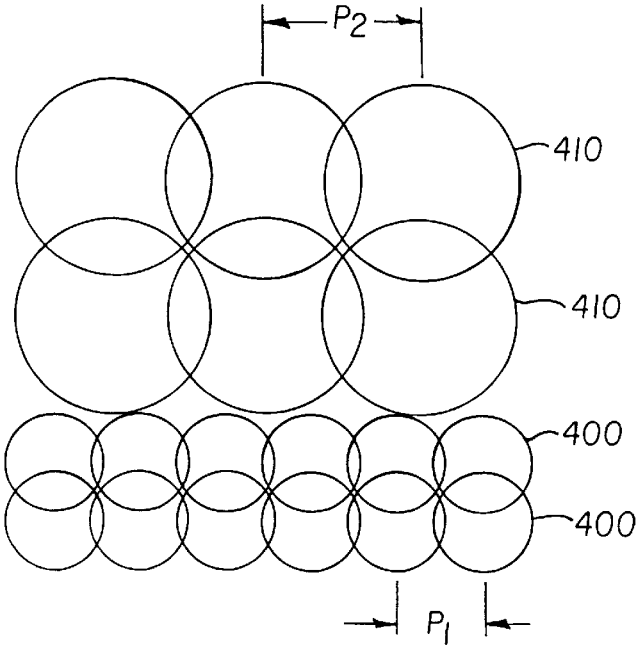
FIG. 4 is an illustration of the ink dots formed by the print bar and the ink jet print heads.

FIG. 4 is an illustration of the ink dots 400 formed by the yellow, magenta, cyan and black print heads 151–154 and the ink dots 410 formed by the print bar. The ink dots 400 for forming the annotation information are smaller in diameter than the ink dots 410 for forming the color image, which is caused in part by the relative nozzles diameters d and d' (FIG. 3). Desirably, the ink dots 400 have diameters equal or smaller that half of the diameters of the ink dots 410. The pixel width $P_1$ for the annotation information and the pixel width $P_2$ for the color image are consistent with the diameters of the ink dots 400 and ink dots 410. Preferably, the color image is formed of color ink dots 410 having diameters at least two times as large as the ink dots 400 in the annotation. One divided by $P_1$ and one divided by $P_2$ respectively define the resolutions of the annotation information and the color image. Typically, the resolutions of the annotation information are in the range of 600–2000 dpi. The resolutions for the color image are in the range of 300–720 dpi. Overlapping areas between the ink dots on the neighboring pixels ensures proper coverage of the receiver 80 so that no white gaps are left in a solid image area on the annotation information or the color image.

The invention has been described in detail with particular reference to certain preferred embodiments thereof, but it will be understood that variations and modifications can be effected within the spirit and scope of the invention.

PARTS LIST

| | |
|---|---|
| 10 | ink jet printing apparatus |
| 20 | computer |
| 22 | display |
| 25 | control electronics |
| 28 | operating parameter control unit |
| 29 | printer engine |
| 30 | printhead drive electronics |
| 31 | print bar |
| 41 | ink reservoir |
| 42 | ink reservoir |
| 43 | ink reservoir |
| 44 | ink reservoir |
| 45 | ink reservoir |
| 46 | ink reservoir |
| 70 | receiver transport mechanism |
| 80 | ink receiver |
| 85 | receiver support |
| 90 | platen |
| 100 | vacuum pump |
| 105 | vacuum tube |
| 110 | platen transport device |
| 115 | ink drop |
| 116 | ink drop |
| 120 | receiver cutter assembly |
| 125 | receiver cutter |
| 130 | receiver roll |
| 150 | narrow print head assembly |
| 151 | yellow print head |
| 152 | magenta print head |
| 153 | cyan print head |
| 154 | black print head |
| 180 | print head holder |
| 200 | sliding rail |
| 210 | supports |
| 220 | belt |
| 230 | pulley mechanism |
| 240 | motor |
| 300 | first magnified portions |
| 310 | ink nozzle |
| 350 | second magnified portions |
| 360 | ink nozzle |
| 400 | ink dot |
| 410 | ink dot |

What is claimed is:

1. Ink jet printing apparatus responsive to a digital image file and high resolution annotation information for forming a color image from the digital image file and the high-resolution annotation information relative to the color image on a receiver, comprising:

a) a print bar disposed at a first image transfer position across at least a portion of a width direction of the receiver and adapted to deliver colorants to the receiver to form the color image on the receiver and having at least two nozzles for each pixel and each nozzle for delivering different color ink for the pixel;

b) a print head assembly spaced from the print bar and disposed at a second image transfer position and adapted to be moved in a direction across the width direction of the receiver for delivering ink to the receiver to form the high resolution annotation information on the receiver;

c) control means for transporting the print head assembly relative to the receiver and for transporting the receiver relative to the print bar and the print head assembly; and d) print head drive electronics responsive to the high resolution annotation information and such digital image for respectively actuating the print head assembly and the print bar to form the color image and high resolution annotation information relative to such color image on the receiver.

2. The ink jet printing apparatus of claim 1 wherein the print bar includes at least one color ink jet print head which is disposed substantially across the full width of the receiver.

3. The ink jet printing apparatus of claim 1 wherein the color image has a lower resolution than the high resolution annotation information on the receiver.

4. The ink jet printing apparatus of claim 3 wherein the color image has a higher bit-depth than the high resolution annotation information on the receiver.

5. The ink jet printing apparatus of claim 3 wherein the color image is formed of color ink dots having diameters at least two times as large as the ink dots in the high resolution annotation.

6. The ink jet printing apparatus of claim 1 wherein the high resolution annotation information is provided by a user and can take the form of text or graphics.

7. The ink jet printing apparatus of claim 1 wherein the print bar includes at least two inks of different colorant concentrations for at least one color.

8. Ink jet printing apparatus responsive to a digital image file and annotation information for forming a color image from the digital image and the high-resolution annotation information relative to the color image on a receiver, comprising:

a) a print bar disposed at a first image transfer position across at least a portion of a width of the receiver and adapted to deliver colorants to the receiver to form the color image on the receiver and having at least two nozzles for each pixel and each nozzle for delivering different color ink for the pixel;

b) a print head assembly spaced from the print bar and disposed at a second image transfer position and adapted to be moved in a direction across a width direction of the receiver for delivering ink to the receiver to form the high resolution annotation information on the receiver;

c) means for transporting the receiver to a printing position where colored images and the high resolution annotation information are to be printed;

d) control means for transporting the print head assembly relative to the receiver and for transporting the receiver relative to the print bar and the print head assembly; and e) print head drive electronics responsive to the high resolution annotation information and the digital image for respectively actuating the print head assembly and the print bar to form the color image and the high resolution annotation information relative to such color image on the receiver.

9. The ink jet printing apparatus of claim 8 further includes a cutter for cutting the receiver to a desired size.

10. The ink jet printing apparatus of claim 8 further includes means for applying a vacuum to the receiver at the printing position.

* * * * *